US006322025B1

(12) United States Patent
Colbert et al.

(10) Patent No.: US 6,322,025 B1
(45) Date of Patent: Nov. 27, 2001

(54) DUAL-PROTOCOL LOCOMOTIVE CONTROL SYSTEM AND METHOD

(75) Inventors: Michael A. Colbert, Springfield, VA (US); Gil Pascal, Frederick; Clive B. Wright, Germantown, both of MD (US)

(73) Assignee: Wabtec Railway Electronics, Inc., Germantown, MD (US)

( * ) Notice: Subject to any disclaimer, the term of this patent is extended or adjusted under 35 U.S.C. 154(b) by 0 days.

(21) Appl. No.: 09/449,617

(22) Filed: Nov. 30, 1999

(51) Int. Cl.[7] ..... B61L 23/00

(52) U.S. Cl. ..... 246/167 R; 246/169 R; 246/187 C; 246/182 R; 340/825.52; 340/505

(58) Field of Search ..... 246/167 R, 169 R, 246/187 C, 182 R; 340/825.52, 505

(56) References Cited

U.S. PATENT DOCUMENTS 4,582,280 4/1986 Nichols et al. .
4,885,689 12/1989 Kane et al. .
5,374,015 12/1994 Bezos et al. .
5,377,938 1/1995 Bezos et al. .
5,720,455 2/1998 Kull et al. .

*Primary Examiner*—S. Joseph Morano
*Assistant Examiner*—Frantz F. Jules
(74) *Attorney, Agent, or Firm*—McGuireWoods LLP

(57) ABSTRACT

An intra-train communication system includes a locomotive control unit (LCU) establishes a communications link between a lead unit and a remote unit which operate using different protocols and/or in different frequency bands. To accomplish this objective, the LCU automatically detects the type of lead unit and remote unit installed on the train. If the types are not the same, the LCU resolves any serial link protocol and arming differences that might exist in a manner virtually transparent to train operators. As a result, data is communicated between the lead and remote units in a way which requires less operator intervention and no software changes to the control computer of the head unit.

16 Claims, 8 Drawing Sheets

DUAL-PROTOCOL LOCOMOTIVE CONTROL SYSTEM AND METHOD

BACKGROUND OF THE INVENTION

1. Field of the Invention

The present invention generally relates to intra-train communications, and more particularly to a system and method for communicating data between a head unit in a lead locomotive and one or more trailing units which operate in accordance with different data protocols.

2. Background Description

Wireless communications systems have been developed for improving the command and control response time of a train. These systems typically include an end-of-train (EOT) unit containing a telemetry transmitter attached to the last car of a train in the place of a caboose, and a computer commonly referred to as a locomotive control unit (LCU) or head-of-train unit installed in the lead locomotive.

EOT units perform three principal functions. First, they monitor various operating conditions of the train including air pressure in the brake line, battery condition, marker light condition, motion, and emergency valve status. EOT units also perform marker light operations and monitor train movement, at least in the rear portion of the train. Second, EOT units transmit the information they monitor to a lead locomotive so that informed command and control decisions may be taken. And Third, the EOT provides the ability to vent air from the brake pipe at the rear of the train in the event of an emergency.

Originally, EOT units were one-way systems, i.e., data was only transmitted from the EOT unit to the LCU where it was then displayed. These one-way units have proven inadequate in a number of ways. Perhaps most importantly, in a one-way system, emergency application of the brakes begins at the lead locomotive and slowly progresses along the train brake pipe until the final car is reached. This sequential application of the brakes increases the time and distance required for the train to come to a complete stop, especially for long train consists. Furthermore, if a blockage or restriction were present in the brake pipe, the brakes beyond the restriction may not engage, increasing the possibility of a derailment and consequently loss of life and property.

Recently, two-way EOT units have been developed which transmit and receive data to and from the LCU. In addition to performing passive monitoring functions, two-way EOT units control air valves in the brake line to effect emergency braking in response to control signals sent from the LCU. The ability to perform a braking application at the rear of the train simultaneously with braking at the front of the train reduces the time and distance required for the train to come to a stop, and thus in at least this way development of two-way EOT units has represented a substantial improvement in the art. An intra-train communications system employing a two-way EOT unit is disclosed in U.S. Pat. No. 5,720,455.

Before command data can be communicated between the LCU and a two-way EOT, a communications link must be established. This link is formed using a communications protocol based on, for example, a handshaking procedure as disclosed in U.S. Pat. No. 4,582,280. In order for emergency commands to be communicated to the EOT unit over this link, the LCU must first be "armed" so that it transmits these commands only to the EOT unit attached to the train. This is desirable in order to prevent the LCU from mistakenly engaging the emergency brakes in other trains which happen to pass by. Arming procedures of this type are disclosed, for example, in U.S. Pat. Nos. 5,374,015 and 5,377,938.

Numerous command protocols are presently in use for communicating data between the LCU and EOT of a train. One of the most common protocols is one approved by the Association of American Railroads (AAR). The AAR protocol transmits digital data using Minimum Shift Keying (MSK) modulation (with mark and space frequencies of 1200 and 1800 Hz, respectively) within a UHF frequency band. Typically, 452.9375 MHz is used for the front-to-rear channel and 457.9375 MHz for the rear-to-front channel. The rear-to-front channel consists of a Unit ID, rear brake pipe pressure, marker light status, last car motion and optional directional status, EOT emergency valve status, and a BCH error detection code. The front-to-read data consists of a Unit ID, a command byte signifying either a communication test command or EOT emergency brake application command, and a BCH error detection code. The arming information on the AAR system resides in the LCU.

Other protocols for communicating data between an LCU and EOT are different from the AAR protocol in terms of the frequency bands over which they operate (i.e., other than the UHF band), the types of digital modulation techniques employed, and the arming procedures used.

With recent consolidation in the railroad industry, it is increasingly the case that trains are being assembled with LCUs and EOTs that operate using different protocols, at least for a portion of their journey. For example, a train configured with an AAR LCU and AAR EOT may be modified to include an EOT operating in accordance with another protocol at some point in an intermediate train yard. This presents compatibility problems, since unless some protocol conversion takes place the LCU and EOT will not be able to communicate with one another.

One system has been proposed to solve this compatibility problem. In this system, an LCU is used which translates between two protocols. This LCU, however, has proven inadequate in at least three ways. First, this system performs protocol conversions solely as the result of manual operations. This system, for example, has a switch on a front panel of the LCU which is manually set by the operator for configuring the LCU so that the protocol conversion can take place.

Second, this manual system requires the IFC software to be either re-programmed or changed to handle differences in the arming procedure. If these software changes are not made, IFC operation would be inconsistent with the EOT operation, which could potentially prevent the system from arming properly.

Third, this manual system is highly susceptible to malfunctioning because of operator error. For example, such a system is potentially dangerous because if the switch on the LCU panel were changed to the wrong setting no communications would take place between the LCU and EOT. As a result, emergency application of the brakes would not be performed at the rear of the train, despite the fact that the IFC would still indicate that the emergency function was available.

A need therefore exists for an improved system and method for resolving the compatibility problems that exist between a head unit and an EOT unit of a train which operate using different protocols, and more particularly one which is more convenient to use and which operates with greater reliability and efficiency compared with conventional systems.

SUMMARY OF THE INVENTION

It is a first objective of the present invention to provide an improved system and method for establishing a communications link between a head unit and remote unit of a train which operates using different communications protocols and/or in different frequency bands.

It is second objective of the present invention to achieve the first objective by automatically detecting the type of head unit and remote unit on the train. including the protocol each operates under, and then automatically performing the protocol and arming conversions required to establish a reliable communications link between the lead unit and remote unit, thereby increasing operational efficiency in a manner which is virtually transparent to the operator.

It is another objective of the present invention to achieve the foregoing objectives without requiring any changes to the software which controls the operation of the head unit, e.g., IFC or ICE.

It is another object of the present invention to provide a system and method of the aforementioned type which increases safety by reducing the possibility that the system will be improperly configured because of human error, thereby ensuring that the train will at all times be operational for an emergency brake application.

It is another objective of the present invention to provide a locomotive control unit which implements the method and which provides pin-for-pin compatibility with a variety of commercially available head unit control computers, including those installed in IFC, LSI, and ICE locomotives.

These and other objectives of the present invention are achieved by providing a system and method for establishing a communication link between a first unit and a second unit of a train. In accordance with this method, a cab control unit in a lead locomotive is provided operating in accordance with a first protocol, and an end-of-train unit is attached to a trailing car of the train, which end-of-train unit operates in accordance with a second protocol. The method then automatically detects in a locomotive control unit that the cab control unit is a type operating in the first protocol. This step is followed by automatically detecting in the locomotive control unit that the end-of-train unit is a type operating in the second protocol. Protocol conversions are then automatically performed in order to communicate information between the end-of-train unit and the cab control unit. Preferably, one of the protocols is the AAR protocol: however, the method of the present invention may be applied to perform the data field conversions required to convert between any two protocols known. The end-of-train unit may be automatically detected according to a polling algorithm and then determining which frequency band a return message is received in. The cab control unit is automatically detected based on the arming procedures that are implemented. The resulting system and method thus advantageously allows different devices to communicate with one another on a single train, thereby increasing operational efficiency and convenience throughout the railroad industry.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
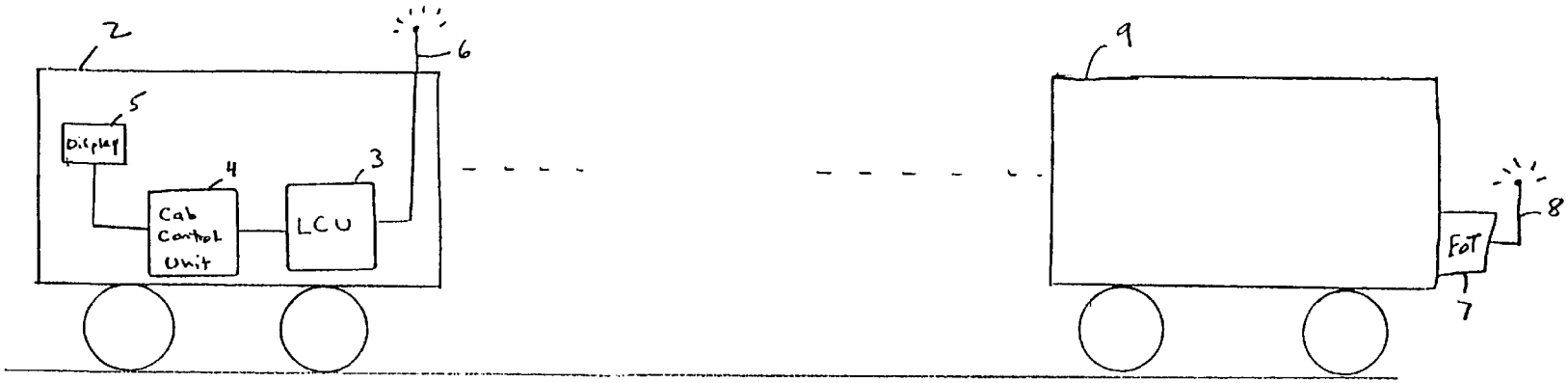
FIG. 1 is diagram of a train incorporating the locomotive control unit in accordance with the present invention.

Referring now to the drawings and more particularly to FIG. 1, an intra-train communications system 1 includes, at a leading end, a locomotive 2 equipped with a locomotive control unit 3 in accordance with the present invention, an integrated cab control unit 4, a display 5, and an antenna 6. Integrated cab control unit 4 may include a computer which integrates all of the electrical systems in the locomotive. Computers of this type include the Integrated Function Computer (IFC) manufactured by General Electric and the Rockwell (now Westinghouse Air Brake Company) integrated cab electronics (ICE) unit. Those skilled in the art can appreciate, however, that unit 4 may be any cab control unit conventionally known. Further, while the locomotive control unit 3 is shown as mounted on the lead locomotive, an optional configuration would place this unit on one or more trailing locomotive, if the train is so arranged.

At a trailing end, system 1 includes a unit 7 and an antenna 8 attached to another locomotive or car 9. Preferably, unit 7 is an end-of-train unit. i.e., one mounted on the last car of the train. In operation, cab control unit 4 communicates with end-of-train unit 7 through locomotive control unit 3 to perform a variety of command and control operations. Preferably, units 4 and 7 communicate bi-directionally along a wireless communications link, however those skilled in the art can appreciate that a one-way link may also exist between these units if desired. In addition, instead of a wireless link, a hard-wired link may be established between units 4 and 7, for example, through a multiple unit (MU) cable of the train.

Locomotive control unit 3 implements the method of the present invention to form a communications link between integrated cab control unit 4 and end-of-train unit 7, even when units 4 and 7 are manufactured by different vendors or operate using different protocols and/or within different frequency bands. The present invention is particularly well suited to resolving compatibility conflicts between AAR-type equipment and equipment which operates according to another protocol, wherein any one of the following combinations may exist between units 4 and 7:

| Integrated Cab Control Unit | End-of-Train Unit |
|---|---|
| AAR | non-AAR |
| AAR | AAR |
| non-AAR | AAR |
| non-AAR | non-AAR |

As those skilled in the art can appreciate, an AAR unit cannot communicate directly with a non-AAR unit because the data transmitted by these units adhere to substantially different protocols. The inherent incompatibility between these protocols stems principally from the radio equipment the AAR and non-AAR units use to transmit and receive data. An AAR radio, for example, transmits and receives data within a UHF frequency band. In contrast, non-AAR radios transmit and receive data within other frequency bands. Moreover, the data transmitted by AAR units and non-AAR units are fundamentally different. There are, for example, certain data fields that exist in the AAR protocol that do not exist in a non-AAR protocol. Because non-AAR and AAR units operate within different frequency bands and transmit/receive data with different data fields, a non-AAR cab control unit cannot directly communicate with an AAR end-of-train unit, and similarly an AAR cab control unit cannot directly communicate with a non-AAR end-of-train unit.

The locomotive control unit of the present invention resolves compatibility conflicts between the AAR and non-AAR protocols in order to form a communications link in a hybrid train configuration. The locomotive control unit forms this link by operating in at least the non-AAR and AAR frequency bands and then adjusting, one or more data fields in the communicated information so that it conforms to the proper protocol required. As a result, messages and other forms of data can be sent back and forth between the integrated cab unit and the end-of-train unit, by way of the locomotive control unit, to effect various command and control functions.

Figure 2:
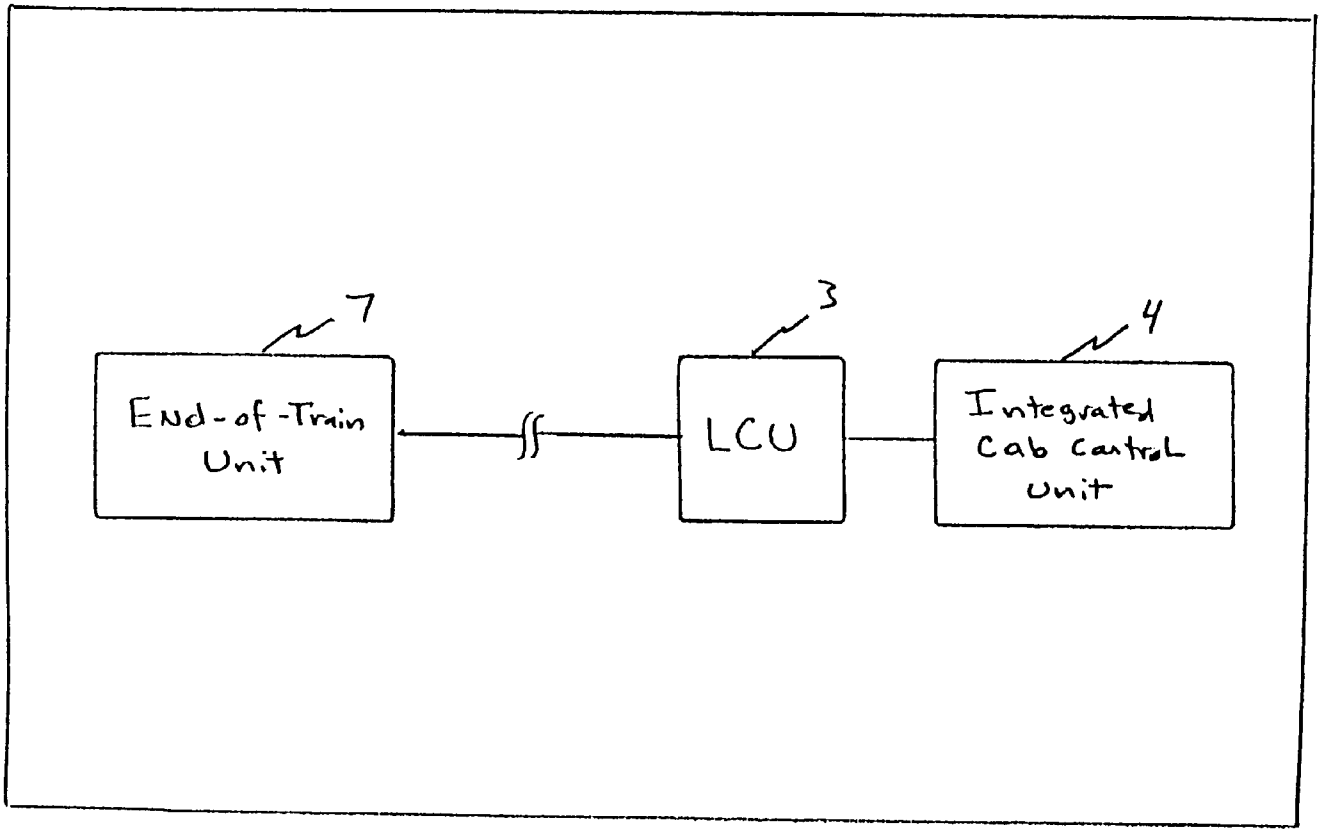
FIG. 2 is a diagram showing one way in which the locomotive control unit of the present invention interfaces between an integrated cab control unit and end-of-train unit for performing frequency and protocol conversions.

As shown conceptually in FIG. 2, the method of the present invention is implemented with the locomotive control unit 3 acting as an intermediary, or interface, between the integrated cab control unit 4 and end-of-train unit 7. As an interface, the locomotive control unit performs the frequency conversions and data field adjustments required to enable units 4 and 7 to communicate with one another.

In order to understand the data field adjustments the claimed invention makes, one must first realize that there are certain data fields that exist in the AAR protocol that do not exist in the non-AAR protocol. Once these data fields have been identified, the locomotive control unit of the present invention adjusts one or more of these fields so that information transmitted using the AAR protocol is converted into information compatible with the non-AAR protocol, and vice versa. The same steps may be taken with any other protocols. Since the protocols are known, it would be well within the ability of one skilled in the art to undertake the conversions required. For example, U.S. Pat. No. 4,885,689, the contents of which is incorporated herein by reference, discloses a multilingual code receiver which detects signals from end-of-train units operating according to a variety of protocols, including AAR and non-AAR protocols. Once received and detected, the protocol conversion required May be readily performed. Methods for converting between protocols are well known in the art, and for example may include those disclosed in U.S. Pat. Nos. 5,377,938 and 5,374,015, the contents of which are also incorporated herein by reference.

Figure 3A:
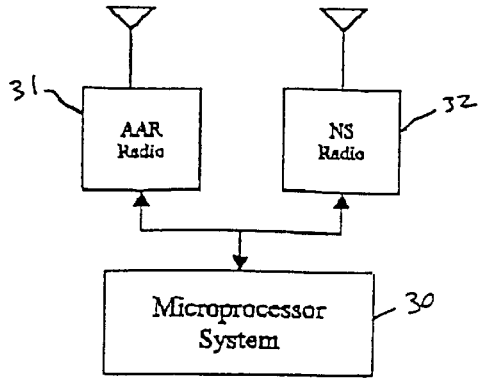
FIG. 3A is a block diagram of an exemplary configuration of the locomotive control unit of the present invention.
Figure 3B:
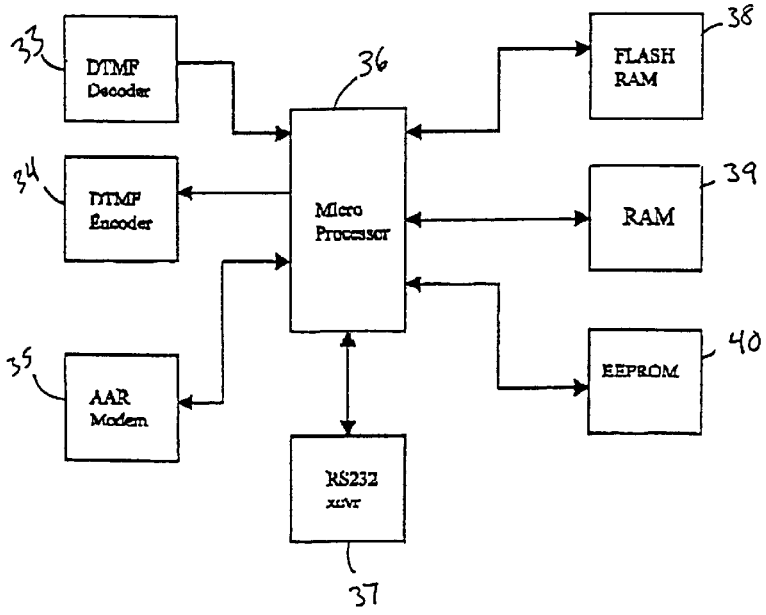
FIG. 3B is an exemplary configuration of a microprocessor system included within the locomotive control unit depicted in FIG. 3B.

FIGS. 3A and 3B are diagrams showing an exemplary configuration of unit 3 for performing the conversion between AAR and non-AAR protocols. Unit 3 includes a microprocessor system 30, a UHF AAR radio 31, and a non-AAR radio 32. The microprocessor system includes a decoder 33 which decodes signals based on the modulation technique used by the non-AAR protocol, an encoder 34 which encodes signals based on the modulation technique used by the non-AAR protocol, an AAR modem 35, a microprocessor 36, an RS-232 transceiver 37, a FLASH RAM 38, a RAM 39, and an EEPROM 40. The non-AAR encoder converts digital commands into signals which can be transmitted. The non-AAR decoder converts received signals into digital commands that can be interpreted by the microprocessor. The RS-232 transceiver allows the microprocessor to communicate with the locomotive. The FLASH RAM holes the microprocessor program used to convert between the AAR and non-AAR protocols, as well as a table used to determine what type of EOT the unit is talking to. The RAM is used for general purpose storage. And, the EEPROM holds the active EOT IDs.

In operation, the microprocessor uses the modem to modulate/demodulate the signal transmitted/received by the radio in the AAR band. In the non-AAR band, the microprocessor uses the non-AAR encoder/decoder to encode/decode the signal transmitted/received by the non-AAR band radio. The microprocessor then uses a control program to perform the conversions between the AAR and non-AAR protocols. Since the frequencies for the two protocols (AAR and non-AAR) are set by the FCC, they are significantly different enough that two separately radios may be employed to perform the transmit/receive functions in each band.

The microprocessor system performs protocol conversion by parsing the messages received from the non-AAR or AAR EOT unit, whichever is connected. The parsed data is then sent to the locomotive IFS using the applicable IFC communication protocol. To do this. the locomotive control unit must determine what type of locomotive, AAR or non-AAR, it is connected to and either expand the data to fill the status message or decimate the data so it will fit. An example of this is the motion fields. The non-AAR EOT does not give the direction the train is moving in, so the locomotive control unit always fills in "forward" if it si connected to an AAR locomotive. Likewise, if an AAR EOT is connected to a non-AAR locomotive, the direction data is merely thrown away. Thus, the field conversions are relatively simple. A more in-depth description now follows.

Figure 4:
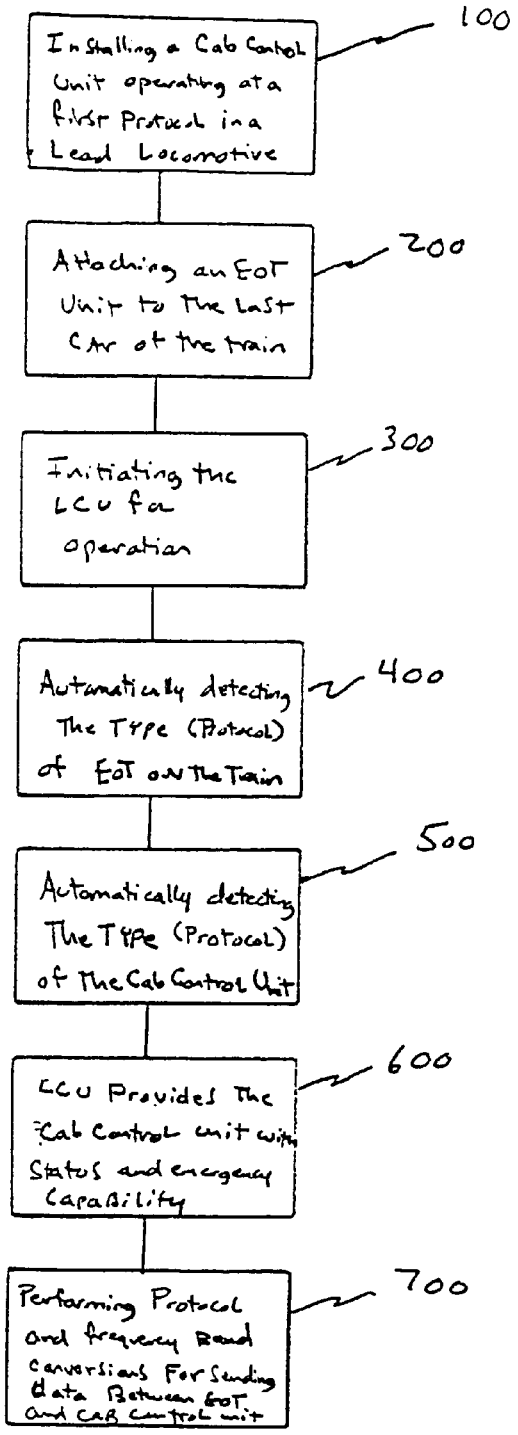
FIG. 4 is a flow diagram of steps included in a preferred embodiment of the method of the present invention.

FIG. 4 is a flow diagram showing steps in accordance with a first embodiment of the method of the present invention for establishing communications between the cab control unit 4 and end-of-train unit 7 operating using different protocols. The method begins by installing a cab control unit in a lead locomotive which operates in accordance with a first protocol. (Block 100). An operator then attaches end-of-train unit 7 to the last car and turns the unit on. (Block 200).

End-of-train unit 7 operates in accordance with a second protocol. The first and second protocols may be the same or different and further may be one or both of the AAR and non-AAR types discussed above.

The locomotive control unit of the present invention is then initiated for operation. (Block 300). The initiation steps include connecting the LCU directly to LCU power. When power is applied to the locomotive, the LCU boots up automatically. The last EOT identification that the LCU was set to remains in non-volatile memory and is used until changed.

Once initiated, the locomotive control unit begins a procedure for automatically detecting the type of end-of-train unit 7 connected to the train. (Block 400). This may be achieved in one of two ways.

The first way involves the use of a look-up table which stores unique identification (ID) numbers for a plurality of end-of-train units. (Block 410). These ID numbers include non-AAR ID numbers and AAR ID numbers depending upon the type of end-of-train unit, and ranges of the AAR and non-AAR IDs are stored in the look-up table. When end-of-train unit 7 is turned on. unit 7 automatically transmits its ID number to locomotive control unit 3. (Block 420). More specifically, unit 7 sends a status message every minute. The ID is contained in the message on both the non-AAR and AAR protocols. In addition, if the test button is pressed on either unit, AAR or non-AAR, a status message is transmitted.

Figure 5:
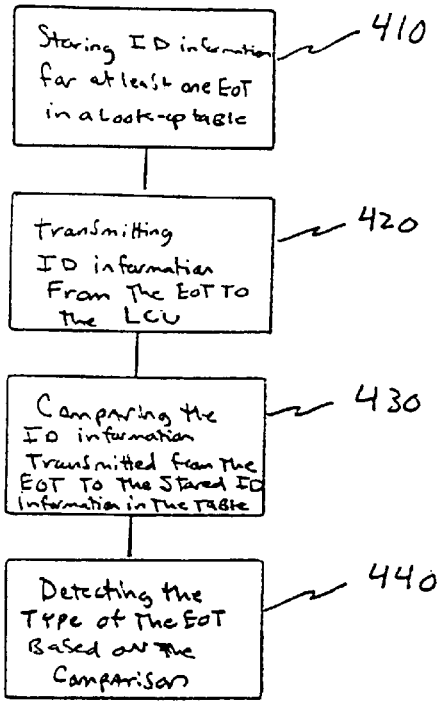
FIG. 5 is a flow diagram showing one procedure the present invention may employ for automatically detecting the type of end-of-train unit connected to a train.

After these steps, unit 3 automatically detects the ID number transmitted from unit 7 and compares this number to the look-up table. (Block 430). The type (e.g., non-AAR or AAR) of the end-of-train unit 7 is then detected, either by finding a direct match between the transmitted ID and an ID in the look-up table or by identifying within which range (i.e., the non-AAR ID range or the AAR ID range) the transmitted ID number resides. (Block 440). See FIG. 5. For example, a non-AAR EOT may lie in a range above an ID number above 20,000 and an AAR EOT may lie in a range below 20,000. The look-up table is preferably stored in a non-volatile memory of the locomotive control unit.

The second way for detecting the type of end-of-train unit 7 is performed if the locomotive control unit cannot determine the type of end-of-train unit 7 from transmission of its ID number. In these circumstances, the locomotive control unit uses a sequence of polls to determine which type of radio exists in end-of-train unit 7. (Block 450). Because the radio frequencies and modulation schemes are different between AAR and non-AAR equipment, end-of-train unit 7 can only be heard on one radio band or the other, i.e., either on the AAR UHF band or the non-AAR band.

Figure 6:
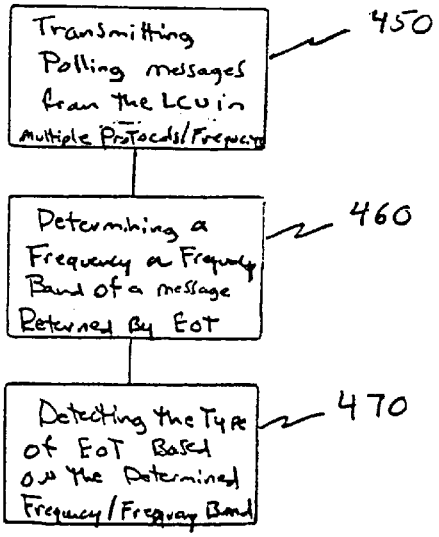
FIG. 6 is a flow diagram showing another procedure the present invention may employ for automatically detecting the type of end-of-train unit connected to a train.

To determine the type of EOT, therefore, the locomotive control unit transmits a request for a message to the end-of-train unit within both the AAR UHF frequency band and the non-AAR frequency band. (Block 460). This step may be performed, for example, as follows. Non-AAR end-of-train units are known to transmit at a predetermined frequency in a predetermined band and AAR end-of-train units are known to transmit at 457.9375 MHz in the UHF band. To determine the type of end-of-train unit 7, the locomotive control unit of the present invention transmits a request for message to the end-of-train unit at both frequencies, either simultaneously or serially. The frequency at which a message transmitted by the end-of-train unit is received by the locomotive control unit then determines the type of the end-of-train unit i.e., AAR or non-AAR. (Block 470). See FIG. 6.

Returning to FIG. 4, in a next step of the method, the locomotive control unit automatically detects the type of locomotive, and more specifically the type of cab control unit 4 which has been installed in the locomotive. (Block 500). The integrated cab control unit 4 may be an AAR type or non-AAR type of protocol conventionally employed on LSI-, ICE-, and IFC-equipped locomotives. Automatic detection of the type of integrated cab control unit 4 is preformed during an arming procedure which enables the locomotive control unit to be able to transmit an emergency braking command to only the end-of-train unit connected to the train, using the ID number specifically assigned to that unit. The arming procedure is important because it ensures that the locomotive control unit will only send the emergency braking command to end-of-train unit 7 installed on the train. On receipt of the emergency braking command, unit 7 would open an emergency valve which triggers an emergency brake application at the rear of the train.

Because the non-AAR and AAR end-of-train units typically have different arming procedures, the automatic detection step in Block 500 of the present invention will differ depending on whether end-of-train unit 7 is an AAR type or non-AAR type.

Figure 7:
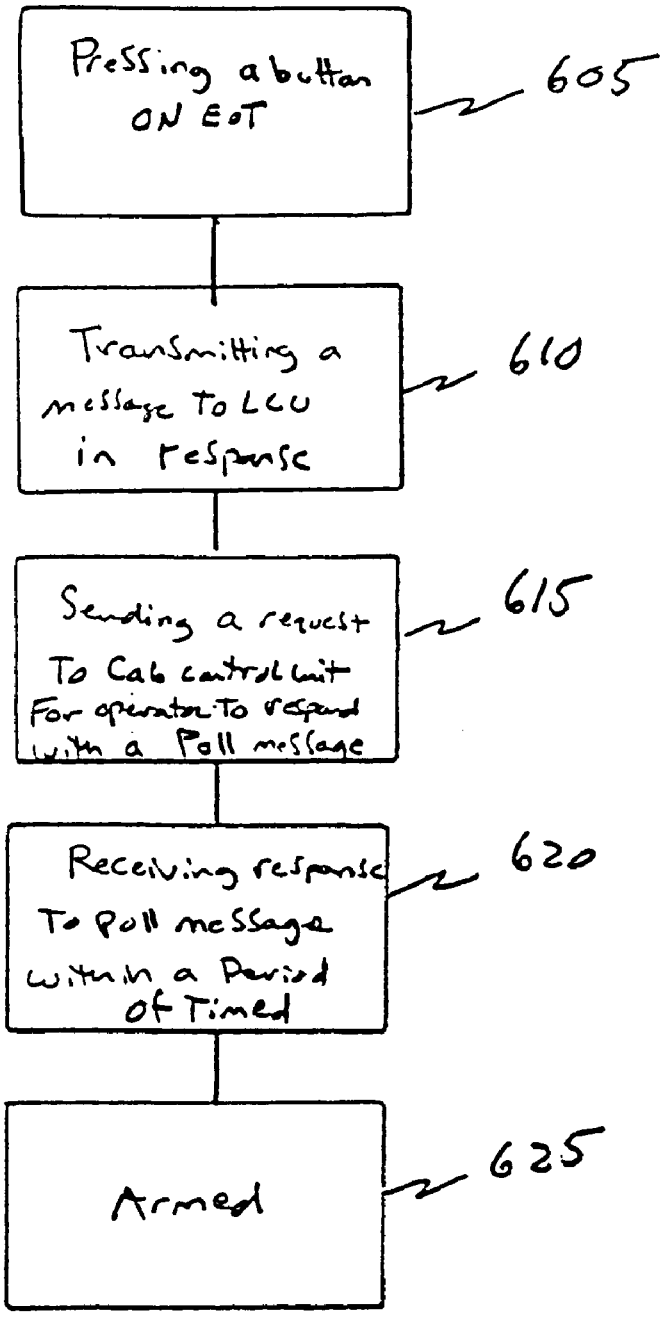
FIG. 7 is a flow diagram showing steps one embodiment of the claimed invention performs for automatically detecting a type of cab control unit in accordance with a procedure for arming an AAR end-of-train unit.

Referring to FIG. 7, the procedure for arming an AAR end-of-train unit begins by an operator pressing a button on the unit. (Block 605). When the button is pressed, a message is transmitted to the locomotive control unit. (Block 610). The locomotive control unit sends a request to the cab control unit, which in turn displays a request for the operator to respond with a "communication poll." (Block 615). If the response to the communication poll is received within a period of time (e.g., 5 seconds) of the button pressed on the AAR end-of-train unit, the locomotive control unit is armed to the end-of-train unit. (Block 620). At this point, the end-of-train ID is stored in a non-volatile memory of the locomotive control unit and an Emergency Enable indicator/message is displayed in the locomotive cab. (Block 625).

Figure 8:
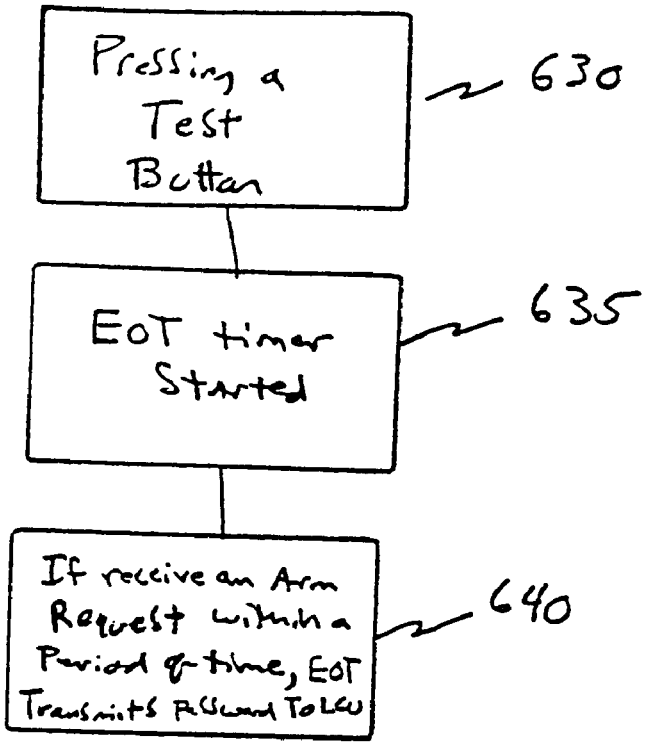
FIG. 8 is a flow diagram showing steps another embodiment of the claimed invention performs for automatically detecting a type of cab control unit in accordance with a procedure for arming an end-of-train unit operating according to a non-AAR protocol.

Referring to FIG. 8, a procedure for arming a non-AAR end-of-train unit also begins with an operator pressing a test button on the unit. (Block 630). However, when the test button is pressed, no message is transmitted to the locomotive control unit as is the case with the AAR unit. Instead. a timer is started on the non-AAR end-of-train unit. (Block 635). If the end-of-train unit receives an arm request within five minutes after the button was pressed, the end-of-train unit transmits a password to the locomotive control unit. (Block 640). This password may then be used by the locomotive control unit to activate an emergency application of the brakes, if required.

The locomotive control unit of the present invention operates in accordance with both arming procedures for detecting the type of cab control unit in the lead locomotive. These arming procedures are further described below.

When the locomotive control unit is installed in a locomotive having, an AAR cab control unit and a non-AAR end-of-train unit is attached to the train, the locomotive control unit provides the same messages to the integrated cab unit as it would if there were an AAR end-of-train unit attached to the train, except during the arming procedure.

Prior to arming, the LCU fills in the data that it has. This data filling is performed with the knowledge that there are specific messages sent from the LCU to the IFC as the result of a status message. The data filling entails setting certain fields to values which will not mislead the operator. The defaults for these fields are specific to the manufacturer, however, no fields can be left "empty" as every field is sent every time. Moreover, each value that is sent in a field (typically, a hexadecimal value) has a specific meaning.

During the arming procedure, the arming button on the non-AAR end-of-train unit is pressed. A first operator at the end of the train then sends a voice radio message to a second operator in the locomotive indicating that this button has been pressed. The operator in the locomotive then presses a "COM TEST" button on the integrated cab control unit to inform the locomotive control unit that the arming button on the end-of-train unit has been pressed. These steps must be taken because an end-of-train unit operating in accordance with the non-AAR protocol is not equipped to send an "ARM NOW" message to the locomotive control unit. (This is one of the inherent differences between AAR-type and non AAR-type end-of-train units).

Once the "COM TEST" message is received by the locomotive control unit, the locomotive control unit sends an "ARM NOW" message to the integrated cab control unit. This enables an "ARM NOW" soft key on the integrated cab control unit (e.g., an Integrated Function Computer manufactured by General Electric), thereby allowing the operator to arm the system. Because there usually is no "COM TEST" in a non-AAR end-of-train unit, pressing the "COM TEST" button on the AAR integrated cab control unit on a train having a non-AAR end-of-train unit can be used as a "switch" to inform the locomotive control unit that it must deal with an AAR locomotive.

More specifically, during the arming procedure, the timing of when the locomotive control unit receives the "ARM NOW" message indicates the type of integrated cab control unit installed on the locomotive. If the locomotive control unit receives the "ARM NOW" message from the integrated cab control unit without having first received a "TEST BUTTON" message from the end-of-train unit, the locomotive control unit automatically identifies the integrated cab control unit as a non-AAR type, e.g., one operating in accordance with a non-AAR protocol in a non-UHF frequency band. On the other hand, if the locomotive control unit receives a "TEST BUTTON" message from the end-of-train unit first and then receives an "ARM NOW" message from the integrated cab control unit, the locomotive control unit automatically identifies the integrated cab control unit as an AAR type, i.e., one operating in accordance with an AAR (UHF) protocol.

When the locomotive control unit is installed in a locomotive having a non-AAR integrated cab control unit and an AAR end-of-train unit is attached to the train, the locomotive control unit must suppress the messages sent from the AAR end-of-train unit that are not applicable or recognizable by the non-AAR integrated cab control unit. (By way of example, one suppressed message may be the "arm status" message. The AAR has eight possible values and the non-AAR has its possible values.) The most significant of these messages is the "ARM NOW" message. When the test button on the AAR end-of-train unit is pressed, an "ARM NOW" message is sent to the locomotive control unit. If the entire system used AAR equipment, this message would be sent to the integrated cab control unit to enable the "ARM NOW" soft key. However, a non-AAR integrated cab control unit does not have this feature, so the enabling of this key is simulated by the present invention.

Specifically, when the "ARM NOW" message is received at the locomotive control unit, the locomotive control unit automatically responds with an "ARM NOW" response to the integrated cab control unit. The operator then has a predetermined period of time (e.g., 5 seconds) to press the "ARM NOW" soft key on the IFC. If the button is not pressed within this period of time. a "DISARM" message is sent and the system returns to an unarmed state.

The type of locomotive is thus determined by the arming sequence, On the AAR locomotive, the ARM NOW command is only generated in response to a button press on an AAR EOT. On a non-AAR locomotive, the "arm now" command is generated by pressing the arm button on the IFC. Thus, the origin of the ARM NOW message determines the locomotive type.

The method of the present invention, thus, resolves protocol and arming differences between an integrated cab control unit and an end-of-train unit when these units operate according to different protocols and/or in different frequency bands. The invention does this by automatically detecting the type of end-of-train unit and integrated cab control unit installed on the train and then adjusts the data fields within the information sent between the integrated cab control and end-of-train units accordingly.

After the cab control unit and end-of-train unit have been automatically detected and the arming procedure implemented or simulated, the locomotive control unit provides the cab control unit with a status and emergency capability applicable to the type detected. (Block 600). In the AAR system, for example, the locomotive control unit provides the cab control unit with information concerning brake pipe pressure, motion, marker status, direction of motion, emergency valve status, and battery status. A non-AAR unit typically provides a subset of this information. The emergency capability on the AAR and non-AAR systems, however, is usually the same. Specifically, when the emergency command is received, the valve at the EOT is opened and the brake pipe is vented. The LCU simply receives the status message from the EOT via the radio link and puts the status information in the fields specified by the IFC protocol. In the transmit mode. the LCU takes the data from the IFC as specified by the IFC protocol and transmits it to the EOT.

At the conclusion of these steps, the locomotive control unit has been configured, or programmed, to perform the protocol and frequency band conversions required to communicate information between the cab control unit and the end-of-train unit that, for example, will enable an emergency brake application and other command and control functions to be performed. (Block 700). These other command and control functions include transmission of any one or more of the status messages previously discussed and the ability to vent air from the end of the train.

Figure 9:
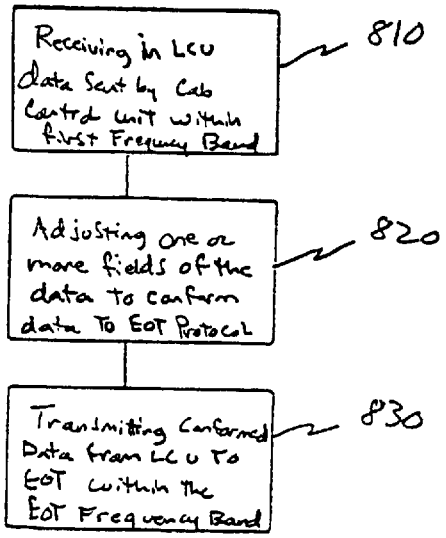
FIG. 9 is a flow diagram showing steps which at least one embodiment of the present invention performs to communicate information from the cab control unit to the end-of-train unit.

The locomotive control unit communicates information from the cab control unit to the end-of-train unit in accordance with steps that include receiving in the locomotive control unit data sent by the cab control unit within a first frequency band. If the cab control unit is an AAR-type unit, the UHF band is used; and if the cab control unit is an non-AAR type unit, another frequency band is typically used. (Block 810). One or more fields of the data is then adjusted so that it conforms to the protocol of the end-of-train unit. (Block 820). The conformed data is then transmitted to the end-of-train unit within the EOT frequency band, where it is then decoded and used to initiate, for example, an emergency brake application. (Block 830). See FIG. 9.

Figure 10:
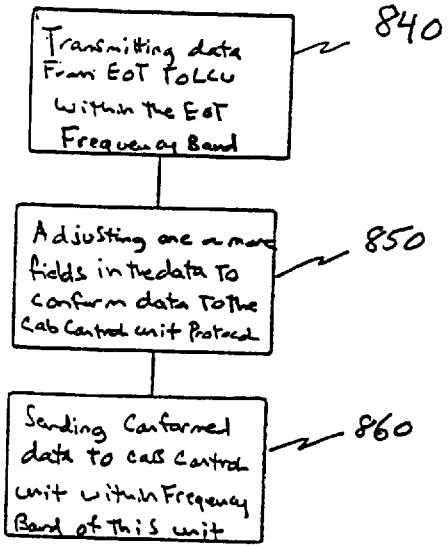
FIG. 10 is a flow diagram showing steps which at least one embodiment of the present invention performs to communicate information from the end-of-train unit to the cab control unit.

The locomotive control unit communicates information from the end-of-train unit to the cab control unit in accordance with steps that include transmitting data from the end-of-train unit to the locomotive control unit within the frequency band of the EOT. (Block 840). One or more fields in the data is then adjusted so that it conforms to the protocol of the cab control unit. (Block 850). The conformed data is then sent to the cab control unit within the frequency band of the cab control unit, where it is then decoded and used accordingly. (Block 860). See FIG. 10.

Preferably, the LCU is loaded with control software for performing the automatic detection and protocol conversion steps of the invention. As those skilled in the art can appreciate, however, one or more of the steps of the method of the present invention may be performed using hardware.

In accordance with optional steps of the method, the locomotive control unit of the present invention may be re-configured, or re-programmed, to establish a communications link when at least one of the integrated cab unit and end-of-train unit are changed.

When a change is made so that the integrated cab unit and end-of-train unit are both the AAR type, the initialization steps of the method are performed. but instead of performing automatic detection of the integrated cab control unit and end-of-train unit, the locomotive control unit operates exactly as conventionally known since both of these units operate in accordance with the same protocol. Specifically, the system arm procedure is performed as follows. The end-of-train unit is attached to the last car, the test button is pressed signaling an "ARM NOW" message to the IFC, the operator presses the "ARM NOW" soft key, and the system arms.

When a change is made so that the integrated cab unit and end-of-train unit are both the non-AAR type, the initialization steps of the method are performed, but again instead of performing automatic detection of the integrated cab control unit and end-of-train unit the locomotive control unit operates exactly as conventionally known, since both of these units operate in accordance with the same protocol. Specifically, the end-of-train unit is placed on the last car, the arm button is pressed, and a voice message is transmitted to the locomotive indicating that the arm button has been pressed. The operator in the locomotive then presses the "ARM NOW" soft key within a certain period of time (e.g., 5 minutes) and the system is armed.

It is to be understood that application of the present method to resolving compatibility conflicts between AAR and non-AAR protocols are merely illustrative of the present invention. To increase versatility and universal appeal, the locomotive control unit of the present invention may execute steps for enable information to be communicated between integrated cab control units and end-of-train units that operate in accordance with protocols and frequency bands other than those observed by AAR and non-AAR. Examples include any of the locomotive system integration (LSI) specifications and ICE protocols, in combination with or in addition to the AAR (UHF) and non-AAR protocols discussed above. Further, the number of frequency bands in which the locomotive control unit of the present invention operates may equal the number of protocols which it is configured to convert between. (LSI is a locomotive system architecture specification developed through a public open-forum processing involving the railroad industry stakeholders. The LSI specifications are recommended by the Association of American Railroads Working Group and approved by the AAR Locomotive Committee.)

Other modifications and variations to the invention will be apparent to those skilled in the art from the foregoing disclosure. Thus, while only certain embodiments of the invention have been specifically described herein, it will be apparent that numerous modifications may be made thereto without departing from the spirit and scope of the invention.

Having thus described our invention, what we claim as new and desire to secure by Letters Patent is as follows:

1. A method for establishing a communication link between a first unit and a second unit of a train, said method comprising:

providing a cab control unit in a lead locomotive, said cab control unit operating in accordance with a first protocol;

attaching an end-of-train unit to a trailing car of the train, said end-of-train unit operating in accordance with a second protocol;

automatically detecting in a locomotive control unit that the cab control unit is a type operating in said first protocol;

automatically detecting in the locomotive control unit that the end-of-train unit is a type operating in said second protocol; and automatically performing protocol conversions required to communicate information between the end-of-train unit and the cab control unit.

2. The method of claim 1, wherein said protocol conversion step includes adjusting data fields of information communicated between the end-of-train unit and cab control unit.

3. The method of claim 1, wherein said first protocol is an AAR protocol and said second protocol is a non-AAR protocol.

4. The method of claim 1, wherein said first protocol is a non-AAR protocol and said second protocol is an AAR protocol.

5. The method of claim 1, wherein the cab control unit operates on within a first frequency band and the end-of-train unit operates in a second frequency band.

6. The method of claim 1, wherein said method further comprises:

communicating information from the cab control unit to the end-of-train unit in accordance with steps that include:

(a) receiving in the locomotive control unit data sent by the cab control unit within said first frequency band, said data being formatted in said first protocol;

(b) adjusting data fields of said data so that said data conforms to said second protocol;

(c) transmitting said data conformed to said second protocol to the end-of-train unit within said second frequency band; and communicating information from the end-of-train unit to the cab control unit in accordance with steps that include:

(d) transmitting data from the end-of-train unit to the locomotive control unit within said second frequency band, said data being formatted in said second protocol;

(e) adjusting data fields of said data so that said data conforms to said first protocol;

(f) sending said data conformed to said first protocol to the cab control unit within said first frequency band.

7. The method of claim 1, wherein said step of automatically detecting the type of the end-of-train unit includes:

storing in the locomotive control unit information for at least one of a possible plurality of end-of-train units, said information including identification information identifying the end-of-train unit attached to the trailing car of said train, said identification information providing an indication of the type of said end-of-train unit;

transmitting identification information identifying the end-of-train unit from the end-of train unit to the locomotive control unit;

comparing the identification information transmitted by the end-of-train unit with the identification information stored in said locomotive control unit; and detecting the type of the end-of-train unit based on an outcome of said comparing step.

8. The method of claim 1, wherein said step of automatically detecting the type of the end-of-train unit includes:

transmitting from the locomotive control unit at least two polling messages, including a first polling message transmitted within a frequency band corresponding to a first type of end-of-train unit and a second polling message transmitted within a frequency band corresponding to a second type of end-of-train unit, one of said first type and said second type corresponding to the type of the end-of-train unit attached to the trailing car of the train;

determining which of said frequency bands a return message was transmitted from the end-of-train unit; and detecting the type of the end-of-train unit as corresponding to said second protocol based on the frequency band determined in said determining step.

9. The method of claim 1, wherein the step of automatically detecting the cab control unit is performed in accordance with an arming procedure.

10. A locomotive control unit for enabling a first train unit to communicate with a second train unit, comprising means for automatically detecting a protocol in which the first train unit operates;

means for automatically detecting a protocol in which the second train unit operates; and performing protocol conversions required to communicate information between the first train unit and the second train unit.

11. The unit of claim 10, wherein said performing step includes:

adjusting data fields within said information.

12. The unit of claim 10, wherein said first protocol operates in a first frequency band and said second protocol operates in a second frequency band.

13. The unit of claim 10, wherein said first protocol is an AAR protocol and said second protocol is a non-AAR protocol.

14. The unit of claim 10, wherein said first protocol is a non-AAR protocol and said second protocol is an AAR protocol.

15. The unit of claim 10, further comprising:

resolving arming differences between the first train unit and the second train unit.

16. The unit of claim 10, wherein the first train unit is an integrated cab control unit in a lead locomotive and the second train unit is an end-of-train unit.

* * * * *